United States Patent [19]

Saito et al.

[11] Patent Number: 4,984,673

[45] Date of Patent: Jan. 15, 1991

[54] STEP OF PASSENGER CONVEYOR METHOD OF MANUFACTURING SAME, AND WAVY METAL PLATE

[75] Inventors: Chuichi Saito, Katsuta; Kazuhira Ojima, Kasama; Yoshihiro Ohsumi, Katsuta, all of Japan

[73] Assignee: Hitachi, Ltd., Tokyo, Japan

[21] Appl. No.: 318,814

[22] Filed: Mar. 3, 1989

[30] Foreign Application Priority Data

Mar. 7, 1988 [JP] Japan ..... 63-51498

[51] Int. Cl.[5] ..... B66B 23/12

[52] U.S. Cl. ..... 198/333; 29/DIG. 3; 29/DIG. 32; 72/187; 198/690.2

[58] Field of Search ..... 198/333, 690.2, 699.1; 182/90, 112, 230; 29/DIG. 3, DIG. 23, DIG. 32; 72/177, 187, 197; 296/181, 183

[56] References Cited

U.S. PATENT DOCUMENTS

| | | | |
|---|---|---|---|
| 2,033,308 | 3/1936 | Shonnard | 198/333 X |
| 4,483,432 | 11/1984 | Ishida | 198/333 |

FOREIGN PATENT DOCUMENTS

| | | | |
|---|---|---|---|
| 147394 | 12/1975 | Japan . | |
| 0009281 | 1/1977 | Japan | 198/333 |
| 0140391 | 10/1979 | Japan | 198/333 |
| 0159990 | 12/1979 | Japan | 198/333 |
| 58-117463 | 8/1983 | Japan . | |
| 985304 | 3/1965 | United Kingdom . | |
| 999785 | 7/1965 | United Kingdom . | |
| 2087331 | 5/1982 | United Kingdom | 198/333 |
| 2127327 | 4/1984 | United Kingdom | 29/DIG. 23 |
| 2137580 | 10/1984 | United Kingdom | 198/333 |

*Primary Examiner*—H. Grant Skaggs
*Assistant Examiner*—D. Glenn Dayoan
*Attorney, Agent, or Firm*—Fay, Sharpe, Beall, Fagan, Minnich & McKee

[57] ABSTRACT

A support surface, particularly for the tread of passenger conveyers, as anti-slip, strengthening and wear resistant grooves deformed in the top portion of cleats formed by corrugating metal.

3 Claims, 11 Drawing Sheets

STEP OF PASSENGER CONVEYOR METHOD OF MANUFACTURING SAME, AND WAVY METAL PLATE

BACKGROUND OF THE INVENTION

The present invention relates to support surfaces, particularly constructed of configured sheet metal. Of particular interest are the steps of passenger conveyers.

In order to prevent passengers from slipping on a step of a passenger conveyer, a hard-to-slip step has been constructed, which is formed by providing grooves on the portions of cleats, which form a tread of a step, for example as shown in Japanese Utility Model Laid-Open No. 147394/1975, or by providing projections on the top portions of the cleats as shown in Japanese Utility Model Laid-Open No. 117463/1983.

SUMMARY OF THE INVENTION

The present invention is usable for support surfaces, such as the bed of trucks, trains or trailers, the surfaces of ramps, or passenger conveyers, particularly escalators and horizontally moving sidewalks. This support surface is configured from deformed sheet metal for lightness, ease of manufacture, and low cost. The horizontal contacting surface is deformed for non-skid purposes, to increase strength, and to provide a hardened wear surface.

BRIEF DESCRIPTION OF THE DRAWING

Further, objects, features and advantages of the present invention will become more clear from the following detailed description of a preferred embodiment, wherein.

DETAILED DESCRIPTION

It has been known to construct step treads from aluminum die castings and to form grooves in the cleats, formed by grooving the portions of the cleats on the top surface of the tread to provide a non-slip surface. With this step, the cleats are cut out partially, so that the strength of the cleats decreases corresponding to the amount of material removed in the cutting process and further corresponding to any stress concentration produced by the cutting process. This promotes the occurrence of breakage of the cleats, and, therefore, this known step is not practically used.

In another type of known tread step formed from corrugated or wavy folded or bent sheet metal plate, projections are formed on the top portions of the cleats to provide the non-slip surface. In such a step, the thin metal plate is used so that it can be folded or bent with ease to form the basic corrugated structure providing the cleats. Therefore, the projections on the top portions of the corrugated metal plate are easily broken, and therefore the non slip functions are lost. Further, there is the possibility that the projections may cause a passenger to stumble. Therefore, this step is not in practical use.

As a partial result of this analysis, which is a part of the present invention, there is obtained, with the present invention, a step, preferably of a passenger conveyer, capable of providing a non-slip surface for passengers, which will not increase the likelihood of passenger stumbling and will not decrease the strength of the base material, all of which is accomplished with the following specific manufacturing process and structural features.

The present invention provides a tread step of a passenger conveyer, having the tread with a plurality of cleats formed by folding or corrugating a thin metal plate to the shape of continuous waves so that the longer axes of the cleats extend in the direction in which the passengers advance, particularly wherein there are a plurality of grooves formed in the outer surfaces of the top portions of the cleats, particularly by pressing or deforming such surface. Preferably, the pressing of the top portions of the cleats is done after the thin metal plate has been formed with the corrugations.

Since the step according to the present invention has no projections to trip and cause passengers to stumble, the passengers do not stumble when they get on the tread. A plurality of grooves in the tread surface prevent the passengers from slipping on the step. Since these grooves are formed by pressing the top portions of the corrugated metal plate, the hardness of these portions of the base material which are around the grooves increases owing to work hardening. This enables the wear resistance of the tread surface to be improved without decreasing the strength of the base material.

Figure 1:
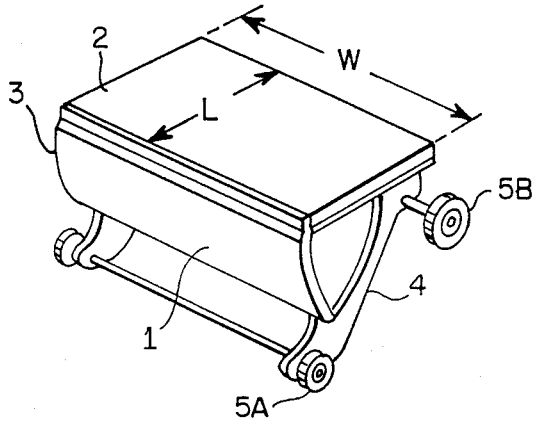
FIG. 1 is a perspective view of a step tread of a passenger conveyer, Particularly an escalator.
Figure 2:
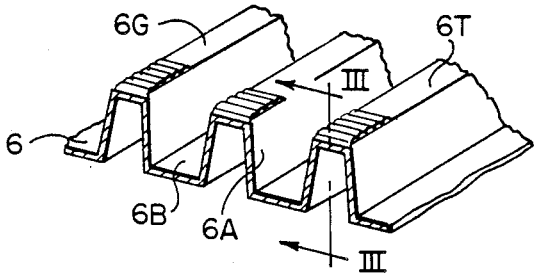
FIG. 2 is an enlarged perspective view of the part of the thin steel plate forming the tread of the step shown in FIG. 1.
Figure 3:
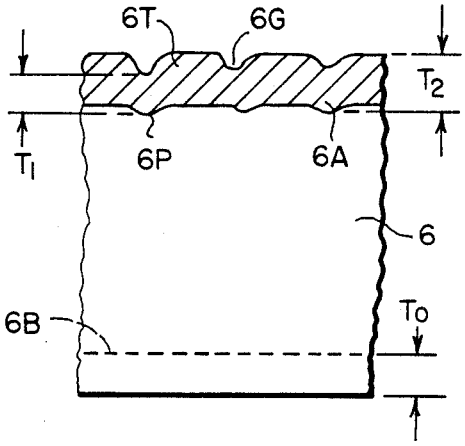
FIG. 3 is a cross-sectional side elevation view taken along line III—III in FIG. 2.

The most preferred use of the support surface is with respect to the tread of a step of an escalator, shown in FIGS. 1–3. The step 1 includes a tread 2 on which passengers ride. A riser 3 extends downwardly from an end of the tread 2, with respect to the direction of advancement. A frame 4 is connected to the riser 3 and tread 2 for their support, and further carries a plurality of wheels 5A, 5B, which are rotatably supported on the frame 4. The tread 2 has a length L in the direction of advancement or path of movement, preferably of 300–500 mm, and a width W between 500–1,500 mm, and consists, for example of a thin stainless steel plate 6 folded continuously to the shape of waves, that is corrugated. The corrugation has a pitch of 10 or more millimeters to thereby form a plurality of cleats 6A and a plurality of recesses 6B, which constitute the tread 2. These cleats 6A and recesses 6B are formed parallel to one another and extend in the direction of advancement or movement of the tread 2.

The cleats 6A have top tread portions that are generally coplanar with each other to form a tread and downwardly extending side wall portions. The top tread portions, side wall portions and recesses 6B are connected with each other by bent edge portions. The outer surfaces of the top tread portions 6T of the cleats 6A constitute the tread or contact surface for supporting people or objects. The top portions 6T are formed with a plurality of grooves 6G. These grooves 6G extend at right angles to the long axis of the cleats 6A, that is they extend laterally of the direction of movement. The groove 6G are formed by pressing the thin steel plate 6 having an original thickness $T_0$ to deform the steel plate 6 to a minimum thickness of $T_1$. The apparent thickness $T_2$ of the top portions of the top tread portions 6T of the cleat 6A increases as compared with the original thickness $T_0$ due to the downward projections 6P and the upwardly swollen portions, which occur when the base material is deformed during the formation of the grooves 6G by the pressing operation. That is, the moment of inertia about the bending axis is increased due to the pressing forming the grooves 6G, to thereby actually increase the beam strength of the top tread portions 6T during the formation of the grooves 6G, which is in contrast to the above analysis of the known step wherein the formation of grooves actually decreases the beam strength of the top tread portions.

The hardness of the portions of the base material in the vicinity of the top tread portions 6T actually increases. That is, in the vicinity of the reduced thickness portion having the thickness $T_1$, the surface of the adjacent metal is work hardened during the pressure forming of the groove 6G due to the metal deformation during groove formation. Accordingly, the wear resistance of the step is improved.

Since the step 1 of an escalator is constructed as described above, the tread 2 on which passengers ride has no projections over which a passenger would stumble (the grooves 6G are so small and so closely spaced that the top surface is effectively smooth with respect to passengers catching on any projection, that is there are effectively no projections, even though the grooves provide a non-slip surface). Therefore, there are effectively no projections over which a passenger would stumble, in contrast to the above-mentioned known step having widely spaced dimples or other projections in sheet metal. At the same time, the grooves 6G in the cleats 6A can prevent the feet of the passengers from slipping on the tread 2, so that this step can be utilized safely.

Since the mechanical strength and wear resistance of the top portions of the cleats 6A are improved owing to the increase of the apparent thickness $T_2$ over the base material and the work hardening effect on the base material, the formation of the grooves 6G does not cause the mechanical strength of the cleats to decrease, and the wear on the tread 2 can be lessened.

The formation of the grooves 6G in the outer surface of the top portion 6T of the cleats 6A will now be described with reference to FIGS. 4–6. The grooves 6G may be formed before the tread 2 has been attached to the riser 3 and frame 4, that is prior to the completion of the step 1 shown in FIG. 1.

First, thin stainless steel plate 6 is folded in a known manner, that is corrugated, to form the general shape shown in FIG. 2, but without the grooves 6G. Thereafter, at least one cleat 6A of the thin corrugated steel plate 6 is then placed on a die 7, as shown in FIG. 4. This die 7 has a cross-sectional shape substantially identical with the shape of the inner contour of the cleat 6A, and a length substantially equal to the length of the cleat 6A. Accordingly, the cleat 6A can be positioned properly by merely placing the cleat on the die 7, and thereafter the grooves 6G can be formed in a proper position with accurate metal deforming rolling, for example.

Pressure rolling or deforming is provided by a pressure roller 8 rotating about an axis of shaft 8S and brought into contact with the top portion 6T of the cleat 6A positioned on the die 7. The cleat 6A is rolled in the lengthwise direction of the cleat as it is pressed in the direction of the arrow a to thereby compress and deform the cleat of an original thickness $T_0$ to the shape as shown in FIG. 3. The pressure roller is provided at its outer circumferential portion with triangular groove-forming teeth 8T, which extend at right angles to the longer axis of the cleat 6A, that is laterally of the direction of movement of the tread in the passenger conveyer. With movement of the pressure roller 8 in the direction of arrow b as shown in FIG. 5, due to rotation of the roller 8 in the direction shown by arrow c, the roller is pressed in the direction of arrow a, as shown in FIG. 4. Thereby, the grooves 6G are formed at regular intervals in the top portion 6T of the cleats 6A. Namely, the pressure roller 8 is moved in the direction of the arrow b as shown in FIG. 5, the groove-forming teeth 8T sequentially deform into the top portions 6T of the plate having an original thickness of $T_0$ of the cleat 6A, and, when each groove-forming tooth 8T reaches the position just under the center of the rotary shaft 8S, the amount of intrusion of the tooth into the top portion 6T becomes maximum. When the groove-forming teeth 8T have passed the position just under the center of the rotary shaft 8S, they leave the top portion 6T successfully, so that the grooves 6G are formed. Therefore, the formation of a groove 6G is carried out during the period of time from the first contact of a tooth 6T with the top surface of the top tread portion 6T of a cleat 6A and ending when the same tooth 6T passes the position just under the center of the rotary shaft 8S, for each groove. When the groove forming tooth 8T embeds itself into the top portion 6T, the corresponding portion of the base material escapes downwardly to form a projection 6P, or the portion of the base material adjacent the tooth 8T escapes upwardly, that is rises so as to fill the space or valley 8G between adjacent groove-forming teeth 8T. That metal is also deformed upwardly into the space between the groove forming tooth and an adjacent groove forming tooth. Finally, the effective thickness of the steel plate becomes $T_2$, which is substantially larger than the original thickness $T_0$.

After a plurality of grooves 6G have been formed in the top portions 6T of the cleats 6A, according to the above process, the thin steel plate 6 is supported on the frame 4 as shown in FIG. 1, to form the tread 2.

Figure 4:
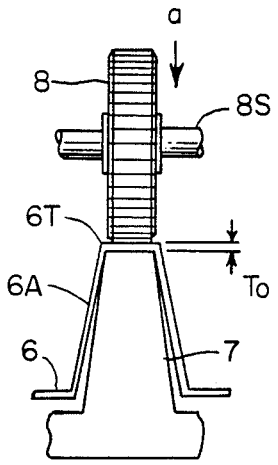
FIG. 4 is a front elevation illustrating the formation of the grooves in the steel plate.
Figure 5:
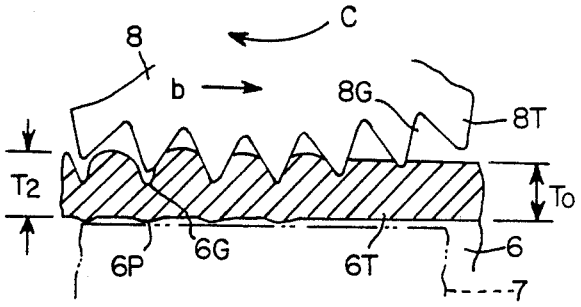
FIG. 5 is an enlarged cross-sectional side elevation view of a principal portion of the process shown in the plane of FIG. 3.

It is possible, according to another aspect of the present invention, not to use the above-described method, but to use a method in which the grooves 6G are formed, also by rolling with a process similar to that shown in FIGS. 4 and 5, before the thin steel plate 6 has been corrugated, or a method in which the grooves 6G are formed after the tread 2 has been corrugated from the steel plate 6 and actually mounted on the frame 4. However, in the method in which the grooves 6G are formed before the thin steel plate 6 has been corrugated, it is difficult to form the grooves 6G in a proper position with respect to the subsequently formed cleats 6A. In the method in which the grooves 6G are formed after the tread 2 has been supported on, that is assembled with the frame 4, the cleats 6A are depressed when the top portions thereof are pressed. Therefore, the preferred method according to the present invention is the formation of the grooves after the sheet metal has been corrugated, but before its assembly with the frame 4 and riser 3 as shown in FIG. 1.

The formation of these grooves 6G is carried out by holding the thin steel plate 6 under pressure between the die 7 and the pressure roller 8. The die 7 may be replaced by a roller having a smooth outer circumferential surface and opposed to the metal deforming roller 8 so as to insert a top portion 6T of a cleat 6A under pressure between such smooth lower roller and the upper pressure roller 8, to pass the cleat 6A therebetween. Also, a tool having horizontally arranged groove forming teeth 8T may be used instead of the pressure roller 8 shown in FIG. 5. Namely, such a tool may be pressed against the outer surface of the top portion of the cleat over the whole length thereof so as to form a plurality of grooves 6G simultaneously along the length of a cleat 6A. Further, it is possible to form the grooves in all of the cleats simultaneously along one lateral line of pressing or metal deforming with rollers, or simultaneously for the entire tread with linear tools.

In the above embodiment a plurality of grooves 6G extending at right angles to the long axis of the cleat 6A, which constitutes a thin steel plate 6, are provided in the top portions thereof over the whole length. Such grooves 6G may also be provided partially, for example in the central portion or peripheral portion only of the surface of the tread 2 shown in FIG. 1. Such non-slip surface is also not limited to grooves. Other shapes of metal deformation in the top surface, according to the broader aspects of the present invention, may be utilized, involving work hardening in the formation of a non-slip surface, although not literally grooves.

In the above-described embodiment, a thin, wavely folded steel plate is used as the step 1 of the passenger conveyer. It is also possible to employ the corrugated sheet metal, formed as described above, as a tread for a floor material for a building or a vehicle, in addition to the step of a passenger conveyer. In such a case, the corrugated steel plate may be formed with the grooves of the present invention for the desired effect of increasing the mechanical strength without any desire to provide a non-slip surface. Further, the processing of the corrugated steel plate or other steel plate according to the present invention, may be for the purpose of providing a wear resistant surface, without any interest being in providing a non-slip surface or in increasing the mechanical strength.

Figure 6:
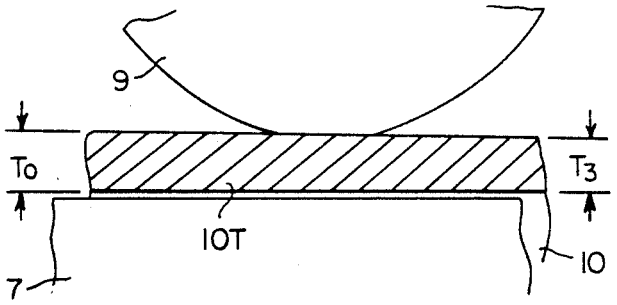
FIG. 6 illustrates an alternate process, as a variation of the process of FIG. 5.
Figure 7A:
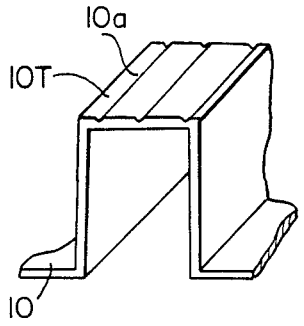
FIG. 7A shows a tread portion, in perspective, with grooves formed in the thin steel plate, as a variation of FIG. 2.
Figure 7B:
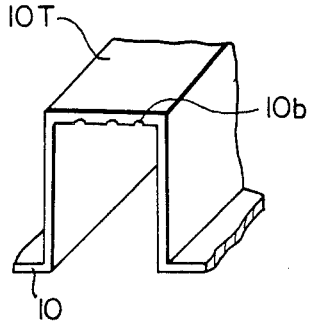
FIG. 7B shows a variation of FIG. 7A.

When a product requires increased mechanical strength, the top wall of a projecting portion 10T, or for that matter a flat steel plate, having a thickness $T_0$ (that is sheet of steel that is flat or corrugated) may be thinned to a thickness of $T_3$ by a die 7 and a smooth pressure roller 9 as shown in FIG. 6, so as to improve the mechanical strength and wear resistance of this top wall by utilizing the work hardening effect of the pressing operation. Referring to FIG. 6, the outer surfaces of the die 7 and the pressure roller 9 are smooth, so that a large pressing force is required to compress the top wall of a projecting portion 10T over its whole width and reduce the thickness thereof. If a die and a pressure roll, which have cross-sections where grooves 10A or 10B are formed in the outer surface or inner surface of the top wall of the projecting portion 10T as shown in FIGS. 7A and 7B, the work hardening effect can be obtained with a comparatively small pressing force. That is, if it is desired to merely work harden the contact surface to increase its wear resistance, without any interest in providing a non-slip surface, it is possible to merely work harden the top surface as shown in FIG. 6 without the formation of any grooves. However, if grooves are formed, even though there is no interest in the non-slip property of grooves, the work hardening may likewise be obtained at a reduced cost, because the amount of work required for work hardening with grooves is less than that required for work hardening with a smooth roll. That is, the formation of grooves has an advantage with respect to reduced costs in work hardening even if grooves ar not otherwise desired.

Figure 8:
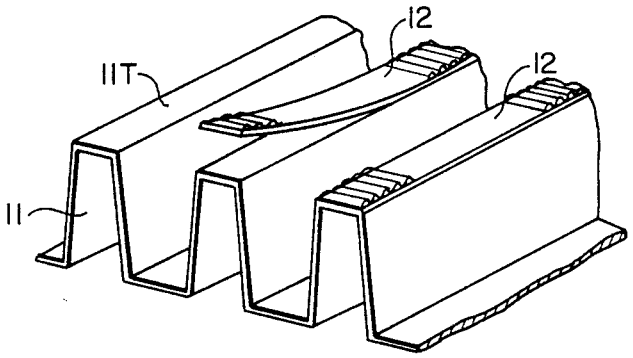
FIG. 8 is a partial perspective view of the tread, showing another groove forming operation, particularly suited for refinishing old treads.

In all of the above examples, a thin steel plate 6 in a corrugated metal plate 10 are deformed by pressing the same directly. For example, in order to furnish the steps of a previously installed or old escalator with a non-slip surface or increased wear resistance, non slip members 12 constructed according to the present invention may be used as shown in FIG. 8. Non-slip members 12 are strips of thin steel plate provided with grooves, for example as shown with the process according to FIGS. 4 and 5 or merely work hardened according to the process of FIG. 6, and thereafter the strips are attached to the outer surfaces of top portions 11T of a thin, corrugated metal plate 11 by known means, including bonding or attachment with screws.

According to the preceding description, a plurality of grooves are formed in the top portions of a thin corrugated or wavy folded metal plate by pressing or metal deformation, so that the mechanical strength of this thin metal plate can be improved with the work hardening effect and the effective increased thickness obtained by the pressing operation. Therefore, a tread of a step of a passenger conveyer, which consists of a top portion of a thin corrugated folded metal plate, and a plurality of such grooves formed in the outer surface of this top portion, can prevent the passengers from slipping, and is further capable of providing improved wear resistance and strength for the tread surface.

Since the formation of these grooves is carried out after the thin metal plate has been folded or corrugated, preferably, and before the metal plate has been installed in a product, the grooves can be formed in a proper position with accuracy, and undesirable deformation of the top portions of the corrugated base material can be prevented. If such a thin corrugated metal plate having the top portions as described above is used as a flooring material, for example with respect to a building or a vehicle, it can serve as the floor with any one of the desirable properties of a non slip surface, a higher wear resistant surface, and increased mechanical strength due to effectively increasing the thickness.

Figure 9:
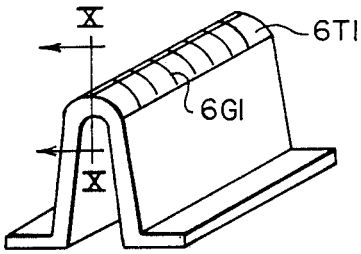
FIG. 9 is a perspective view of a rounded top cleat structure according to the present invention.
Figure 10:
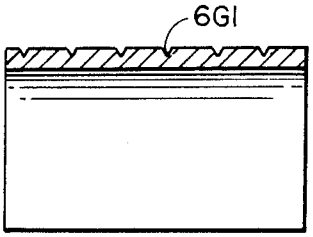
FIG. 10 is a partial cross-sectional view taken along line X—X in FIG. 9.

Using the same basic process as described above to produce broadly the structure described above with the mentioned advantages, the present invention may be employed with respect to cleats having a rounded top tread portion 6T1 as shown in FIG. 9, with the cross sectional shape being roughly shown in FIG. 10. These grooves 6G1 can be formed with a pressure roller similar to the pressure roller 8 shown in FIG. 9, but with an outer periphery arcuately formed in a curve to match the curve of the top tread portion 6T1, and correspondingly the die, such as die 7 shown in FIG. 4, would be provided with a complementary curved portion.

Figure 11:
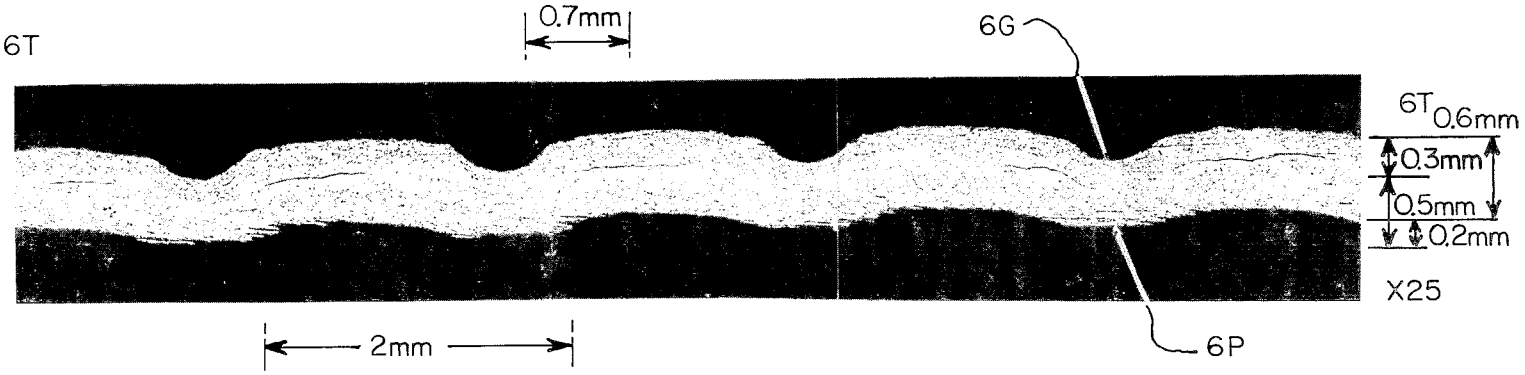
FIG. 11 is a micrograph of the cross-section shown in FIG. 2.
Figure 12:
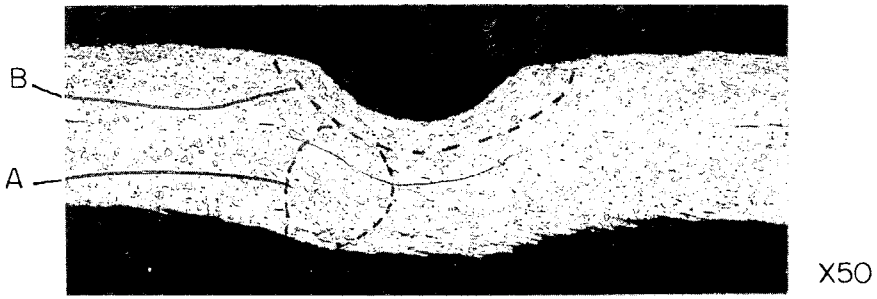
FIG. 12 is an enlargement of a portion of the micrograph from FIG. 11.

As shown in FIG. 10, it is seen that the entire top surface of the sheet metal is work hardened, as evidenced by the closely spaced illustrated structure in the micrograph adjacent the top surface, specifically with work hardening structure being shown within the dotted lines B wherein the structure is dense, in contrast to the coarse original structure within dotted lines A, of the enlarged micrograph, FIG. 12. The micrograph, in FIG. 11, is a 25 times enlargement, whereas the micrograph of FIG. 12 has been enlarged 50 times. For reference, the specific dimensions of the actual structure is shown in FIG. 11, that is $T_0=0.6$ mm, the depth of the grooves is 0.3 mm, the distance from the bottom of a groove to the bottom of a portion 6P is 0.5 mm, so that as seen the effective thickness of the sheet metal has been increased 0.2 mm, by the deformation according to the present invention.

Figure 13:
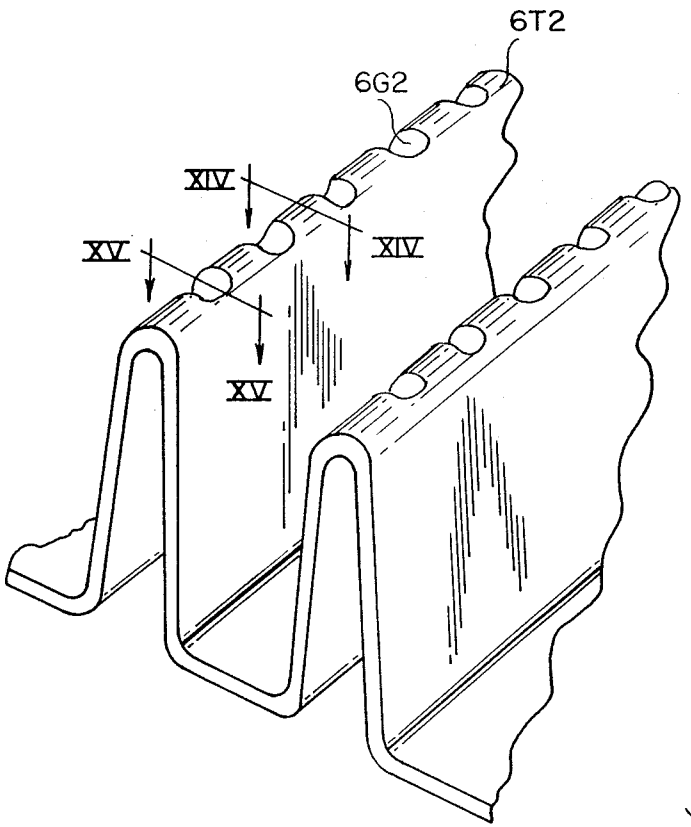
FIG. 13 is a perspective view of a rounded top tread constructed according to the present invention.

If the cleats are formed with curved upper top tread portions 6T2, as shown in FIG. 13, that is a basic corrugation similar to that of FIG. 9, and the pressure roll 8 of FIG. 4 is employed for forming the grooves, preferably with a die 7, the groove 6G2 will be formed as shown in FIG. 13 with respect to the top tread portions 6T2. By way of example, the original thickness of the steel plate may be 0.6 mm, the pitch of the corrugation may be 8.5 mm, the width of the recesses may be 3.5 mm, and the height of the cleats may be 11 mm. The internal structure is shown in the micrographs FIG. 14 and 15, respectively for the bottom of the grooves 6G2 and the midportion of the material of the top tread portion 6T2 between grooves in FIG. 15.

The corrugated sheet metal with the grooves formed according to the present invention may be used, as previously mentioned, for a moving sidewalk or roadway, which is similar in construction to an escalator, but which provides only a flat horizontal surface that is linearly moved horizontally, or at an incline, particularly for the fast movement of passengers on foot along one floor. This type of roadway or moving sidewalk is composed of pivotally connected pallets, with the pallet being particularly shown, for one example, in FIGS. 16 and 17. The pallet may have a width, lateral to the moving direction, of 1,000 mm and a length, in the direction of the movement, of 400 mm. The pallet thickness may be 100 mm. The corrugated metal plate 6 with cleats 6A, constructed as previously described, is mounted, for example by spot welding or bonding, to a cleat base 15, preferably composed of a plurality, three being shown, of sheet metal beams, which cleat base is spot welded or otherwise bonded or secured to a frame 16. The frame 16 is preferably a rectangle of four connected beams, which may be deformed sheet metal beams connected with screws or welding.

Figure 18:
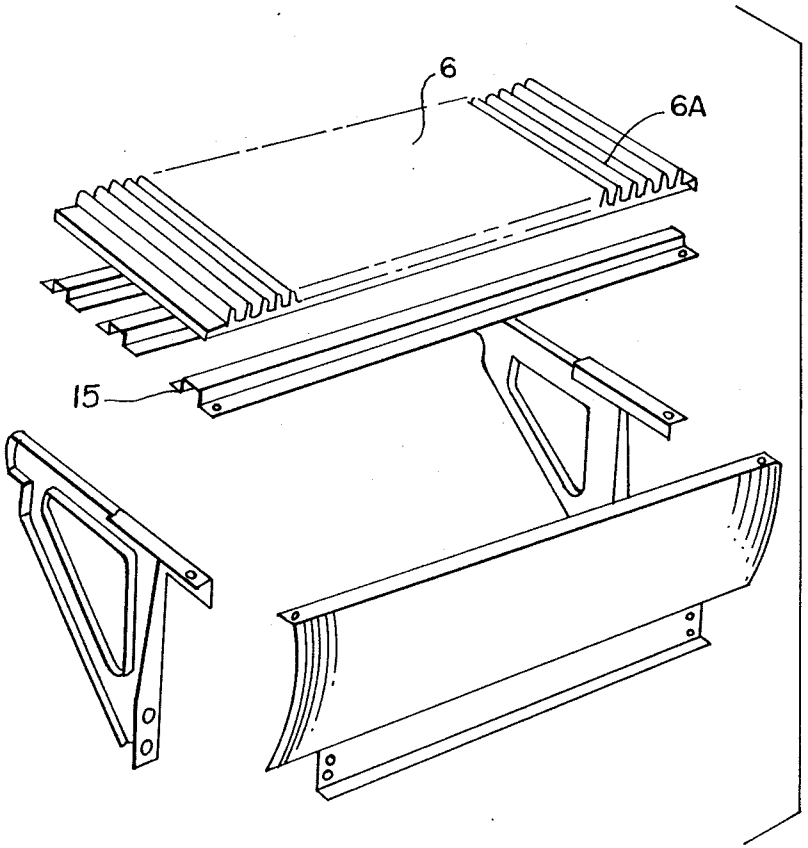
FIG. 18 is an exploded view of the escalator step shown in FIG. 1.
Figure 16:
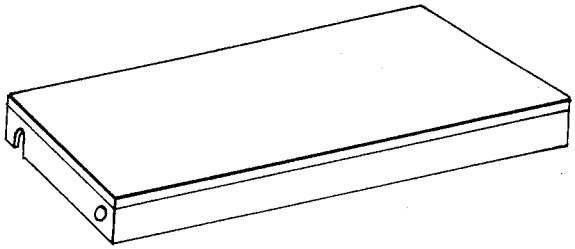
FIG. 16 shows a perspective view of a pallet usable with an escalator or moving roadway, according to the present invention.
Figure 17:
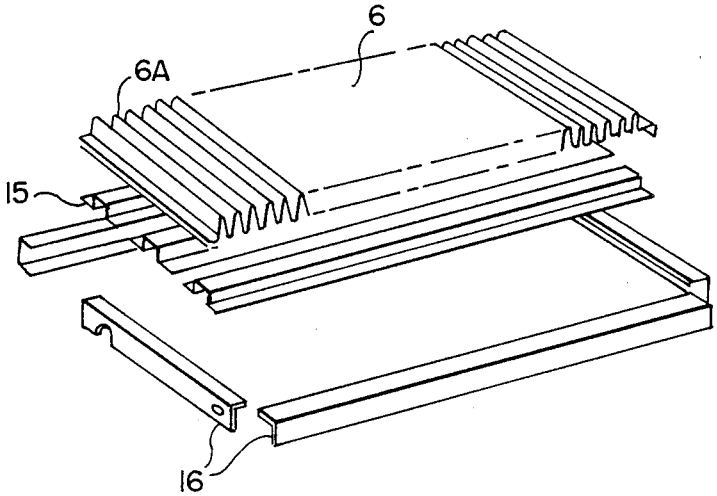
FIG. 17 is an exploded perspective view of the pallet shown in FIG. 16.

As shown in FIG. 18, the escalator step may have the same width, length and depth dimensions as the pallet of FIGS. 16, 17, and the same construction for the corrugated sheet metal 6 and cleat base 15. As before, the corrugated plate 6 is preferably secured to the cleat base 15 by spot welding, and the cleat base is preferably secured to brackets or frame 4 and riser 3 by screws or bolts, with a riser 3 also being secured to the frame 4 with bolts, or alternatively with welding.

Some electric or moving roads are inclined more gently than escalators, while others are installed horizontally. With either installation, their treads comprise a plurality of cleats formed by corrugating thin stainless steel sheets to the shape of continuous waves. During operation, these treads are flush with each other, unlike escalators in which treads are formed into a plurality of steps. Since the basic construction of electric roads or moving side walks or roadways and escalators is well known, their basic structure will not be repeated here.

Further, the corrugated plate 6 of the present invention may be the top horizontal support surface for stationary stairs, that is stairs having rigidly interconnected alternating risers and treads, for example as used in stairways between floors of a building, internally or exteriorly of the building. The work hardening and grooves of the present invention function in the same manner for such stationary treads.

While the method of forming the grooves has been schematically illustrated, particularly with reference to FIGS. 4, 5 and 6, it is understood that a plurality of such rollers may be mounted on a horizontal guide rail to be reciprocated horizontally with a fluid cylinder across a stationary die holder mounted on a base for holding the corrugated metal plate, so that a plurality of cleats may be deformed simultaneously.

Figure 19:
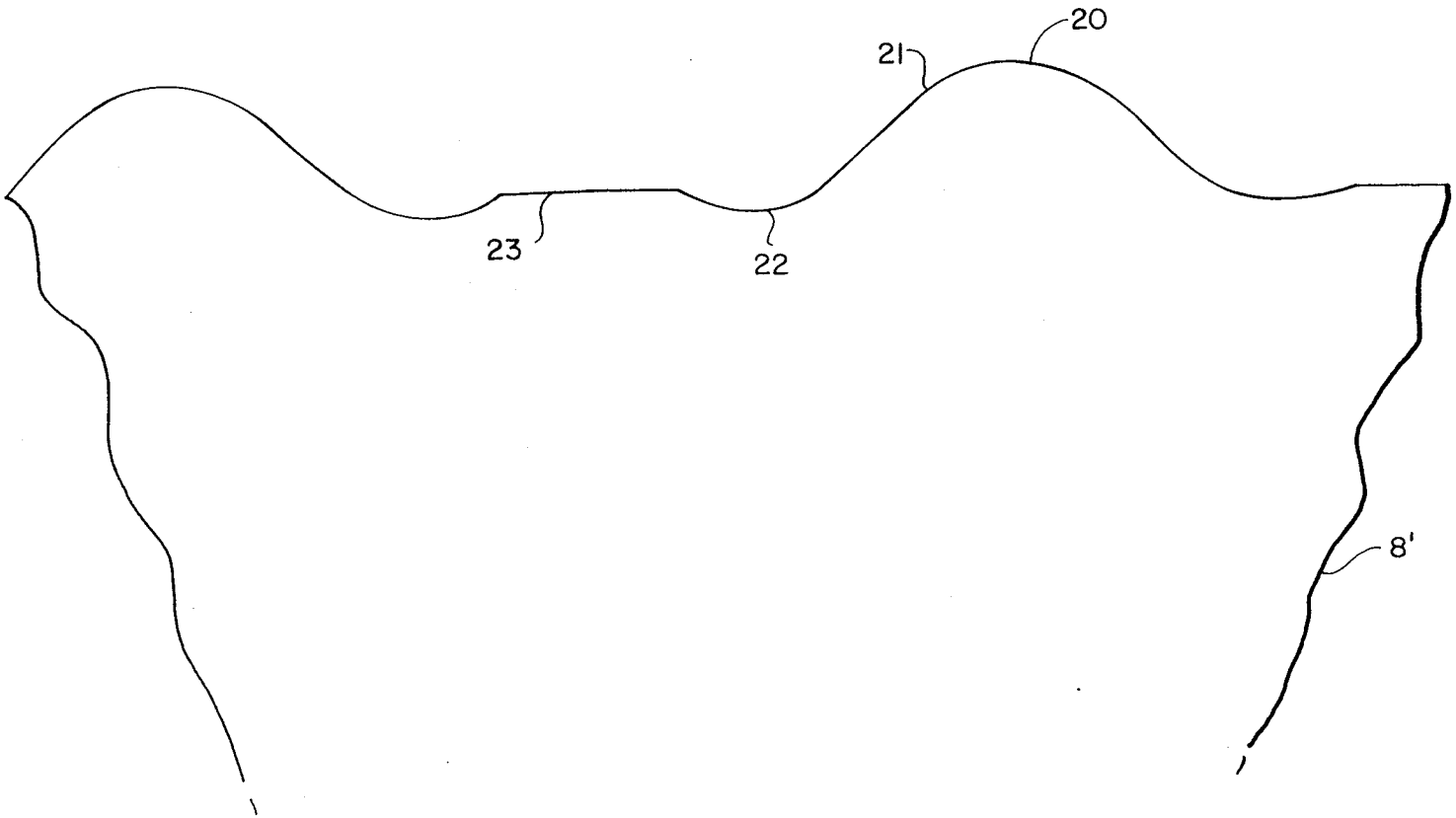
FIG. 19 is an enlarged portion of a most preferred form of the roller used according to the process shown in FIG. 4, taken in a plane corresponding to FIG. 5.

Most preferably, the roller 8 has the specific structure as shown in FIG. 19. As seen, the top portion 20 of each tooth is arcuately formed, for example with a radius of 0.326 mm extending over 90 degrees, the side portions 21 of the teeth are preferably linear and leading into the valley between teeth. Each valley comprises respective concave portions, for example having a radius of 0.3 mm blending with the straight portion 22 of the tooth on one side and adjoining a central flat portion 23 between them. Each tooth 20, 21 provides a groove forming projection. The raised center portion of the valley between adjacent teeth form a bending correction projection. With this specific shape of roller, the power required for metal deformation in bending grooves is reduced, the contacting portion of the tread between the adjacent grooves is work hardened as shown by the micrographs to increase wear resistance. As mentioned, the metal displaced by the deformation of the teeth being embedded in the sheet metal to form the grooves is controlled in its displacement according to the portions 21, 22, 23 and work hardened as indicated in the micrographs to provide the above-mentioned upwardly swollen portions between adjacent grooves.

Figure 14:
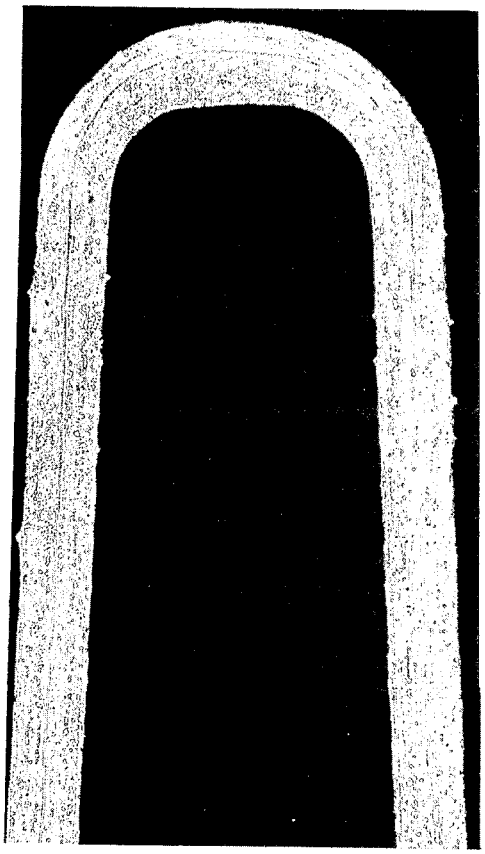
FIG. 14 is a micrograph taken along line XIV—XIV in FIG. 13.
Figure 15:
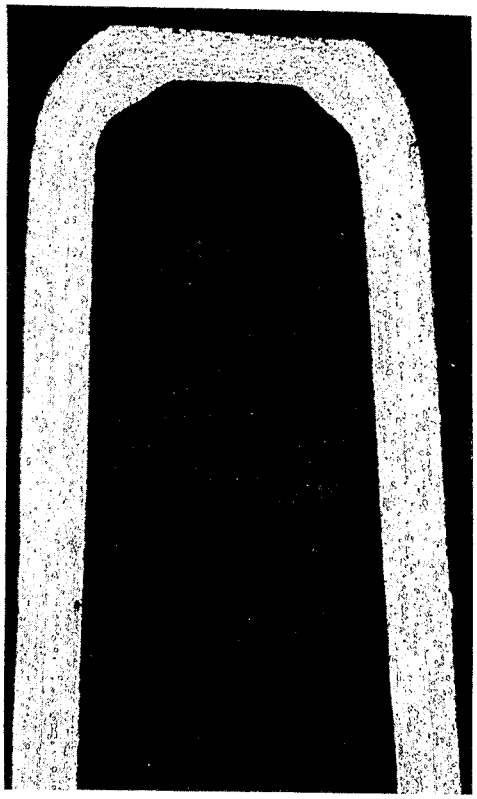
FIG. 15 is a micrograph taken along line XV—XV in FIG. 13.
Figure 20:
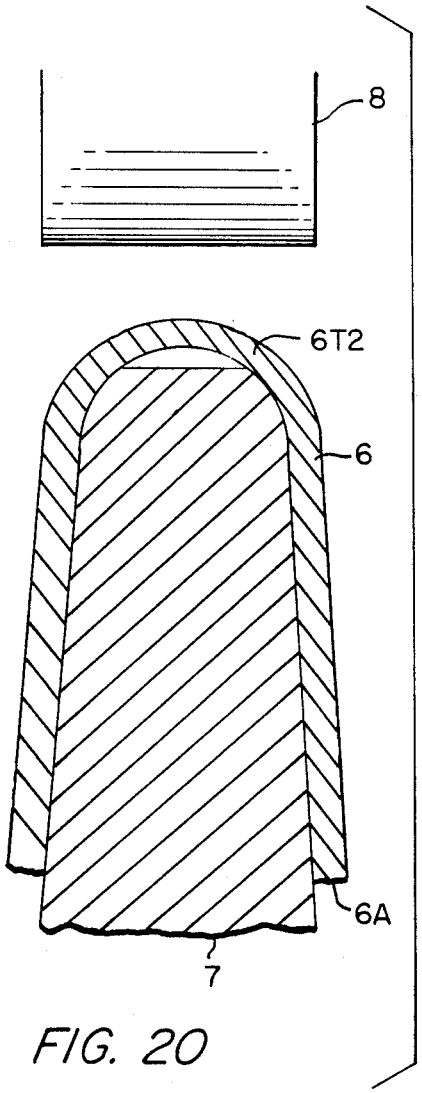
FIG. 20 is an enlarged view of a roller prior to deforming a cleat held on a die.
Figure 21:
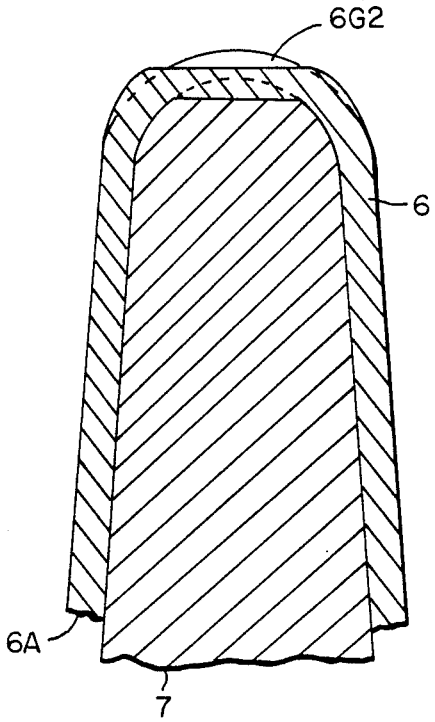
FIG. 21 is a cross-sectional view, corresponding to FIG. 20, but after deformation.

For forming the cleats shown specifically in FIGS. 13–15, a specific embodiment of die and roller are shown in FIG. 20 with a cleat therebetween, prior to the formation of grooves. It is to be noted that the cleat, prior to formation of the grooves, has its top tread portion with a substantially semicircular outer periphery of 2.6 mm diameter and inner periphery of generally semicircular configuration having a diameter of approximately 1.4 mm. The die is preferably provided with the general interior shape of the cleat, except at the top portion of the die wherein the edges are approximately 0.5 mm radius blending to a central top portion of 0.4 mm, which is flat and horizontal. After deformation by the roll, the cross-sectional shape is that shown in FIG. 21.

Figure 22A:
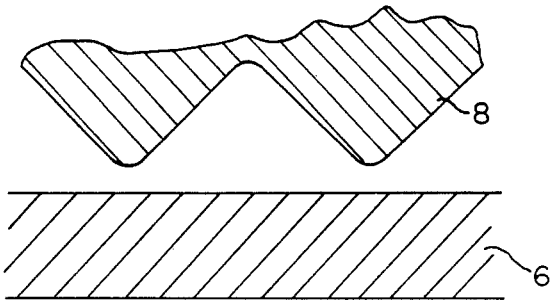
FIGS. 22A through 22E show the progression of metal deforming in forming the grooves with one type of roller according to the present invention.
Figure 22:
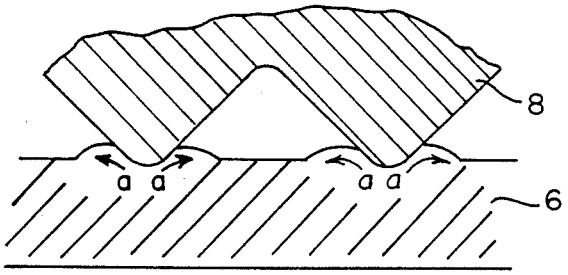
Figure 22C:
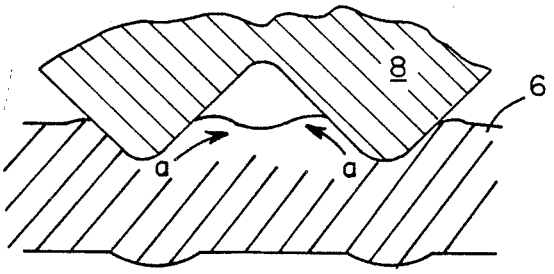
Figure 22D:
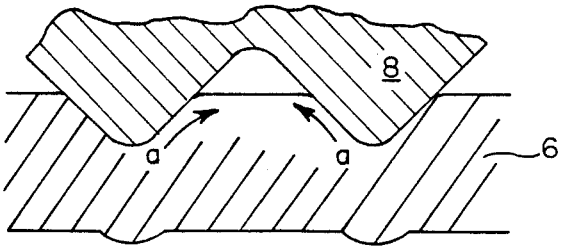
Figure 22E:
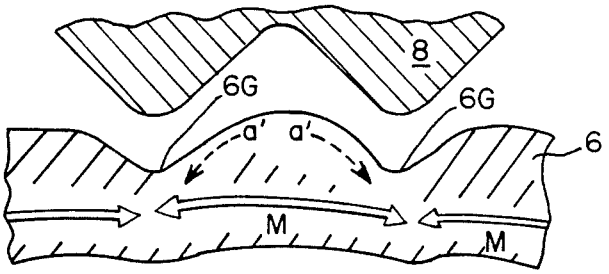

According to the present invention, using a conventional tooth profile for the roller 8, deformation proceeds as shown in FIGS. 22A through 22E. As the roller 8 is pushed into the sheet metal 6, proceeding from FIG. 22A to FIG. 22D, the material in the top surface compresses and receives forces causing-metal flow generally in the direction of arrows a at portions between the teeth of the roller 8, generated by the embedding of the teeth within the metal of the sheet 6. As a result, when the roller is removed, reaction forces a′ act in the opposite direction from the previous forces a, as shown in FIG. 22E, which in turn generate a bending moment M in each portion between the grooves G. The bending moment M in each portion between these grooves, when combined, will bend the entire material to an outwardly curved shape. That is, the result is that the material between the grooves is outwardly curved upward or convex.

Figure 23A:
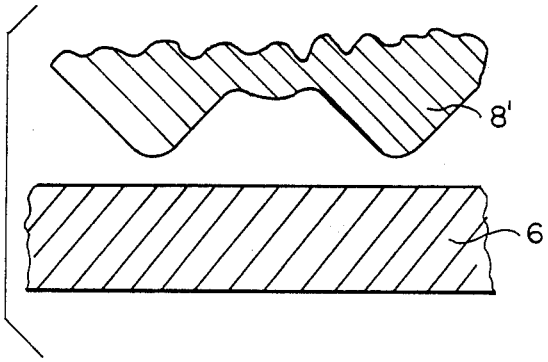
FIGS. 23A through 23D show a groove forming method employing a differently constructed roll from that employed in FIGS. 22A through 22E.
Figure 23B:
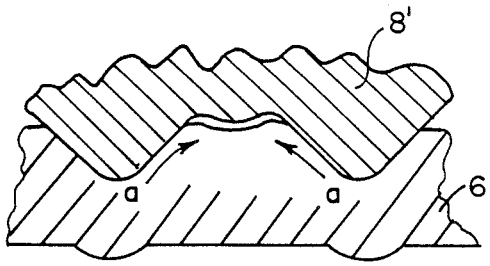
Figure 23C:
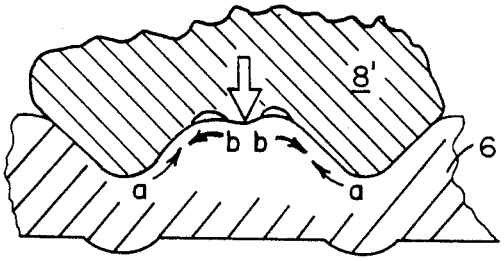

While the deforming roll 8 according to FIGS. 22A through 22E provides a satisfactory product, the preferred form of the present invention employs the roller having the specific structure as shown in FIG. 19. The metal deformation provided by the roll shown in FIG. 19 is specifically illustrated in FIGS. 23A–D. When the roller 8′ presses into the surface of the sheet metal 6 as shown in the progression of FIGS. A–B, forces a act to provide metal flow at the indicated portions between the teeth of the roller to allow these portions to protrude. When the roller is further pushed into the sheet metal 6, as shown in FIG. 23C, a bending correction projection between the teeth compresses a relative protruding portion to generate counter forces b that cancel out the forces a. As a result, even when the roller is removed as shown in FIG. 23D, there are no reaction forces remaining inside the material, and therefore, no bending of the material occurs.

Figure 23D:
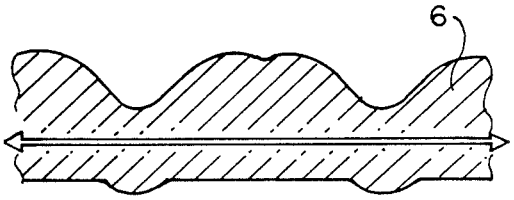

From a comparison of FIG. 22E and FIG. 23D, it is seen that the roller according to FIG. 22 provides for a concave or arcuate surface between grooves, whereas the roller and process according to FIGS. 23A–D, the surface between the grooves is generally flattened. Thus, the resulting structure of FIG. 23D generally has a flatter work hardened surface between grooves than the more rounded structure of FIG. 22E. Furthermore, the surface between the grooves in the structure of FIG. 23D has more surface work hardening than the structure in FIG. 22E, due to the flow of material in forces as analyzed above.

As an experiment, four plates with correspondingly formed cleats were manufactured and tested. The first plate was of corrugated stainless steel without any work hardening or groove formation according to the present invention. The second plate was of identical construction to the first plate and further processed by providing laterally extending teeth filed into its surface for test purposes, that is it was not processed according to the present invention even though cut teeth were provided in depths and spacing similar to those provided by the present invention. The third plate was identical to the first plate and thereafter processed according to the present invention by metal deformation to provide the grooves, as described above. The fourth plate was unprocessed aluminum, with the corresponding cleat construction according to a prior art technique of cast aluminum, mentioned above. Each of these plates was tested in the same manner, that is by providing the metal tread in its normal horizontal support orientation, and providing a weighted shoe on its support surface or tread, and thereafter pulling the shoe in the forward direction of the shoe and the moving direction of the tread, that is according to the long axis of the cleats and cross-wise of the grooves, while measuring the pulling force. Thereby, according to conventional calculations and procedures, the coefficient of friction was determined for each of the plates.

For a typical children's shoe, with a load of 20 kilograms, the coefficient of friction of the tread surface was determined to be 0.55 for the first plate, 0.57 for the second plate, 0.61 for the third plate (the present invention), and 0.58 for the fourth plate. When an adult's leather shoe was used with the load of 62 kilograms, the coefficient of friction for the first plate was determined to be 0.5, 0.6 for the second plate, 0.66 for the third plate (the present invention), and 0.58 for the fourth plate. The differences in coefficient of friction for the children's and adults shoes was in part due to the children's shoe having a rubber sole and the adult shoe having a leather sole.

Also, measurements were made with the four plates, a weighted shoe and increasingly tilting the plate until the weighted shoe started to slide. Although an inclined electric road generally has an inclination angle of 11.3 degrees, the tread according to the present invention did not cause the weight to slide even at an inclination angle of 31 degrees.

It is therefore seen that the tread constructed according to the present invention has a much improved coefficient of friction, that is much improved non-slip properties, as compared with the prior art and other test plates. This increased coefficient of friction, non-slip property, is obtained without weakening the plate, and in fact the strength of the plate is increased by increasing the effective thickness of the top tread portion. Further, this increased coefficient of friction is obtained while at the same time increasing the wear properties of the top tread portion, due to work hardening the top tread portion. Further, the wear resistance is particularly improved with the rolling employing a roller configured according to FIG. 19, wherein the top tread portion between adjacent grooves has superior work hardening and flatness as compared with the roller shown in FIG. 22A and the resulting product of FIG. 22E.

As noted in FIG. 22E, the residual forces within the sheet metal 6 tend to deform the top tread portion, as a whole, due to the bending moments M and therefore, the entire corrugated plate takes on a curvature. Even if the recess portions of the cleats were welded, the top tread portions would tend to have a general curvature extending in the direction of movement of an escalator, for example, due to such moments M.

With the structure as shown in FIG. 22E, there is wear concentration due to the convex surface between adjacent grooves, whereas in FIG. 23D, the surface between adjacent grooves is generally flat to distribute the wear, so that there is not wear concentration. In both cases, wear properties are enhanced by work hardening, and the structure of FIG. 23D has improved wear properties additionally due the improved work hardening.

Due to the cancellation of the forces a, b, as shown in FIG. 23C, when the die and roller are removed, the residual forces, if any, are generally linear as indicated by the arrows in FIG. 23D, which is in contrast to the residual bending moments M shown in FIG. 22E. As a result, there is no overall deformation of the plate, and particularly no overall deformation or curvature in the top tread portions for the structure of FIG. 23D in contrast to the structure of FIG. 22E.

While a preferred embodiment has been set forth along with modifications and variations to show specific advantageous details of the present invention, further embodiments, modifications and variations are contemplated within the broader aspects of the present invention, all as set forth by the spirit and scope of the following claims.

We claim:

1. A movable passenger conveyor comprising:

a plurality of step units arranged serially in a loop with adjacent step units pivotally interconnected about parallel axes to form the passenger conveyor;

each of said step units being sheet steel folded with a plurality of parallel corrugations to produce top tread portions extending generally coplanar for forming a tread, bottom recess portions, generally vertically extending wall portions and, bent edge portions connecting said wall portions to said tread portions and recess portions;

said tread portions and generally vertically extending wall portions forming a plurality of parallel cleats extending in a longitudinal direction transverse to said axes;

means forming a wear resistant surface on said tread, including an outer work-hardened upwardly facing metal surface between said edge portions;

said means including a plurality of parallel grooves deformed into the top surface of said sheet steel of said tread portions;

each of said grooves extending generally transverse to said longitudinal direction; and a plurality of parallel grooves deformed into the bottom surface of said sheet steel of said tread portions in alternating relationship with said grooves deformed into the top surface to thereby corrugate each of said top tread portions in a direction perpendicular to said longitudinal direction so that the overall thickness of each tread portion is substantially greater than the thickness of the remainder of said sheet steel so that said means further increases the bending strength of the tread portions in the direction perpendicular to said longitudinal direction.

2. A movable passenger conveyor according to claim 1, wherein each of said step units is generally 300 to 500 mm in length and 500 to 1,500 mm in width;

said sheet steel is stainless steel; and the upper portion of said loop extends generally horizontally to form a conveying road.

3. A movable passenger conveyor according to claim 1, wherein each of said step units is generally 300 to 500 mm in length and 500 to 1,500 mm in width;

said sheet steel is stainless steel; and the upper portion of said conveyor loop extends coplanar generally at an acute angle with respect to the horizontal to form an escalator, and said step units each include a riser.

* * * * *